US010827813B2

(12) United States Patent
Abrahamyan-Smith

(10) Patent No.: US 10,827,813 B2
(45) Date of Patent: Nov. 10, 2020

(54) MULTIFUNCTIONAL LUGGAGE WITH INTEGRATED CHANGING STATION AND CHILD SEAT

(71) Applicant: Anna Abrahamyan-Smith, Las Vegas, NV (US)

(72) Inventor: Anna Abrahamyan-Smith, Las Vegas, NV (US)

( * ) Notice: Subject to any disclaimer, the term of this patent is extended or adjusted under 35 U.S.C. 154(b) by 0 days.

(21) Appl. No.: 15/907,252

(22) Filed: Feb. 27, 2018

(65) Prior Publication Data

US 2018/0242707 A1 Aug. 30, 2018

Related U.S. Application Data

(60) Provisional application No. 62/464,284, filed on Feb. 27, 2017.

(51) Int. Cl.

| | |
|---|---|
| ***A45C 15/00*** | (2006.01) |
| ***A45C 13/38*** | (2006.01) |
| ***A47B 23/06*** | (2006.01) |
| ***A47D 1/10*** | (2006.01) |
| ***A47D 5/00*** | (2006.01) |
| ***A45C 5/14*** | (2006.01) |
| ***A45C 9/00*** | (2006.01) |

(52) U.S. Cl.

CPC ..... *A45C 15/00* (2013.01); *A45C 5/14* (2013.01); *A45C 9/00* (2013.01); *A45C 13/385* (2013.01); *A47B 23/06* (2013.01); *A47D 1/10* (2013.01); *A47D 5/006* (2013.01); *A45C 2009/002* (2013.01); *A45C 2009/007* (2013.01)

(58) Field of Classification Search

CPC .. A45C 15/00; A45C 5/14; A45C 9/00; A45C 13/385; A45C 2009/002; A45C 2009/007; A47B 23/06; A47D 1/00; A47D 5/006

See application file for complete search history.

(56) References Cited

U.S. PATENT DOCUMENTS

| | | | | |
|---|---|---|---|---|
| 5,819,999 | A * | 10/1998 | Tennant | A45F 4/02 224/155 |
| 6,390,431 | B1 * | 5/2002 | Ott | A45C 13/00 248/229.23 |
| 7,278,644 | B2 * | 10/2007 | Villarreal | A47B 3/10 190/12 A |
| 8,201,672 | B2 * | 6/2012 | Yang | A45C 5/14 16/32 |
| 8,517,398 | B1 * | 8/2013 | Wilson | B62B 1/12 280/37 |
| 8,905,207 | B2 * | 12/2014 | Hamilton | A45C 13/262 190/1 |
| D742,638 | S * | 11/2015 | Melanson | D3/274 |
| 9,326,575 | B2 * | 5/2016 | Moore | A47B 3/10 |
| 2005/0098402 | A1 * | 5/2005 | Cohen | A45C 5/14 190/12 A |
| 2007/0158156 | A1 * | 7/2007 | Chen | A45C 5/14 190/11 |
| 2010/0123347 | A1 * | 5/2010 | Lin | A47C 4/54 297/452.41 |

(Continued)

*Primary Examiner* — Tri M Mai

(74) *Attorney, Agent, or Firm* — Steven Rinehart

(57) ABSTRACT

A multifunctional luggage implement configurable to form a child seat, desk and/or changing station, having a retractable stroller portion in some embodiments.

10 Claims, 15 Drawing Sheets

(56) References Cited

U.S. PATENT DOCUMENTS

| | | | | |
|---|---|---|---|---|
| 2012/0325607 | A1* | 12/2012 | Webster | A45C 5/143<br>190/115 |
| 2015/0107949 | A1* | 4/2015 | McDonald | A47C 27/081<br>190/2 |
| 2016/0081469 | A1* | 3/2016 | Undesser | A45C 13/26<br>108/41 |

* cited by examiner

MULTIFUNCTIONAL LUGGAGE WITH INTEGRATED CHANGING STATION AND CHILD SEAT

FIELD OF THE INVENTION

This invention relates to luggage, and more particularly relates to a multiconfigurable luggage implement for accommodating combined child and luggage transport.

BACKGROUND

Description of the Related Art

It can be very difficult for parents and guardians to port both luggage and small children through airports, city streets and in other crowded areas, especially because doing so usually requires a parent to carry both the luggage and children separately. Luggage, car seats, child carriers, and strollers are well-known in the art, but have not previously been integrated into a single luggage piece for facilitating more efficient travel and transport of personal item and children in an airport environment.

Traditional methods of transporting children have proved to be dangerous. Children under 5 years of age are frequently hospitalized after falling from shopping carts, after falling out of their parents arms at airports, and after being hit by others in airports. Approximately one third of these head injuries were concussions, fractures or internal injuries.

A child carrier accessory is needed which integrates solves these deficiencies and integrated a stroller, luggage and cart into a single carrier.

SUMMARY

From the foregoing discussion, it should be apparent that a need exists for an multifunction luggage implement which would overcome inefficiencies with the prior art by providing a retractable stroller and child transport means.

The present invention has been developed in response to the present state of the art, and in particular, in response to the problems and needs in the art that have not yet been fully solved by currently available apparti. Accordingly, the present invention has been developed to provide a multifunctional luggage implement comprising: a cubic luggage container; a plurality of retractable wheels which rotate axially on one or more axes; a plurality of planar panels affixed to a top surface of the luggage container which unfold to form a changing station and seat for a child; a foldable detachable panel insertable into the side of the luggage container which folds to form a seat for a child, wherein the foldable detachable panel forms a plank for resting the child upon in an airplane; and one or more handles for pushing the luggage implement.

The multifunctional luggage implement further comprising a plurality of detachable beverage containers for insulated and containing one or more beverages. The planar panels may fold open to form a desk.

The planar panels may fold open to form a child changing station.

In some embodiments, the retractable wheels extend to form a cart for porting incidental luggage. The planar panels may detach to form a bed for resting a child between seats of an airplane.

A second multifunctional luggage implement is provided comprising: a cubic luggage container comprising: a forward housing defining a rectangular recess for receiving a foldable detachable panel, and a rearward housing hingedly connected to the forward housing; a plurality of casters affixed to a bottom surface of the forward housing; a plurality of casters affixed to a bottom surface of the rearward housing; a panel assembly comprising a plurality of planar panels, the panel assembly affixed to a top surface of the luggage, the planar panels adapted to unfold to form a changing station and seat for a child; a foldable detachable panel insertable into the side of the luggage container which folds to form a seat for a child, wherein the foldable detachable panel forms a plank for resting the child upon in an airplane; and one or more handles for pushing the luggage implement.

The multifunctional luggage implement may further comprise a plurality of detachable beverage containers for insulated and containing one or more beverages.

The planar panels may fold open to form a desk. The planar panels may alternatively fold open to form a child changing station.

The planar panels may detach to form a bed for resting a child between seats of an airplane.

The multifunctional luggage implement may further comprise a handle affixed to the rearward housing.

In various embodiments, the multifunctional luggage implement further comprises a semi-rectangular handle slidably affixed to the rearward housing, the semi-rectangular handle adapted to slide within a track defined by the rearward housing.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
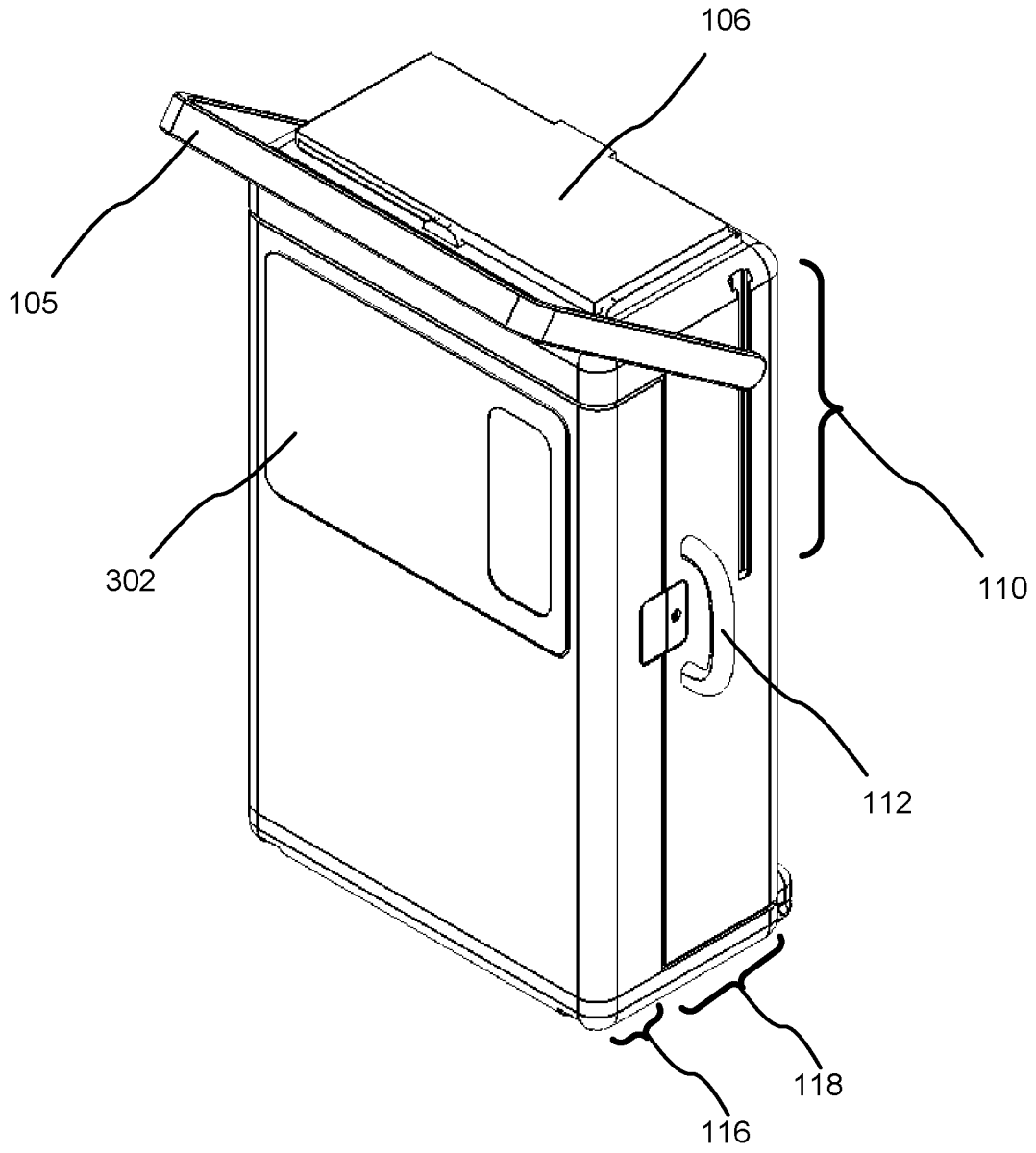
FIG. 1A is a top, forward side perspective view of a multifunctional luggage implement in accordance with the present invention.
Figure 1B:
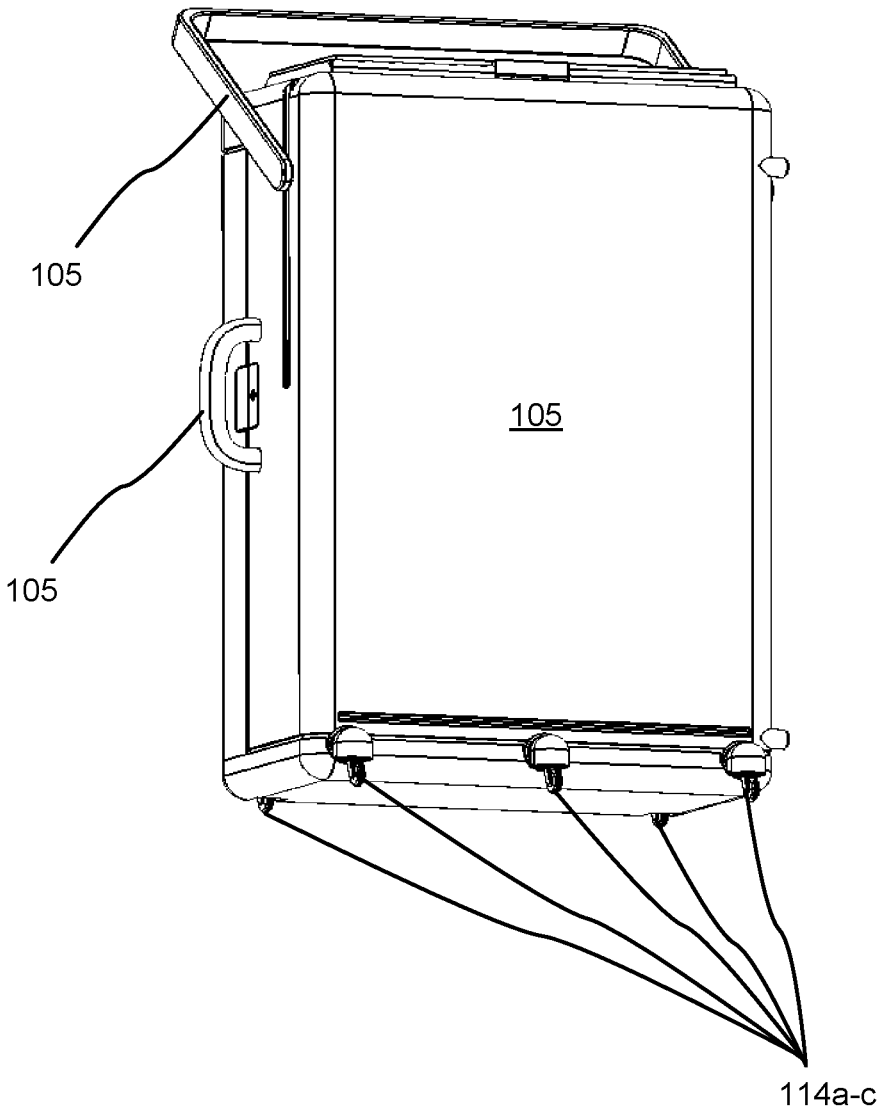
FIG. 1B is a lower side perspective view of a multifunctional luggage implement in accordance with the present invention.
Figure 1C:
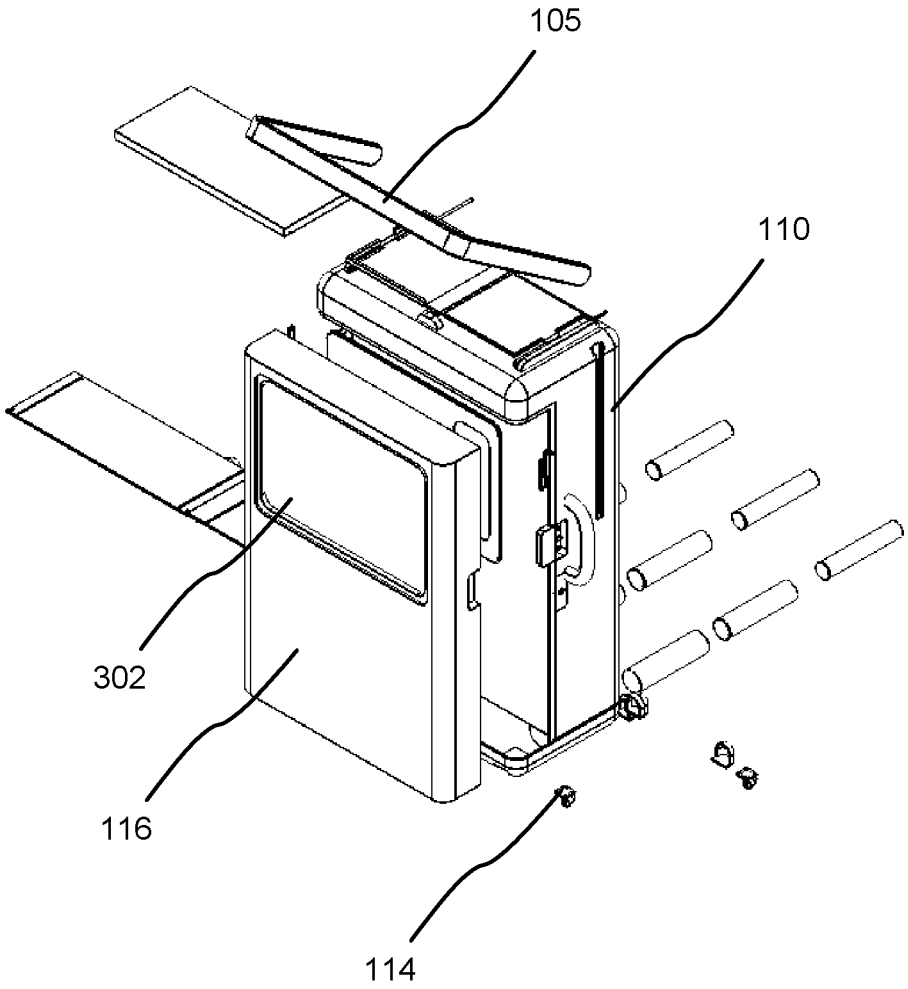
FIG. 1C is a disassembled top side perspective view of a multifunctional luggage implement in accordance with the present invention.
Figure 1D:
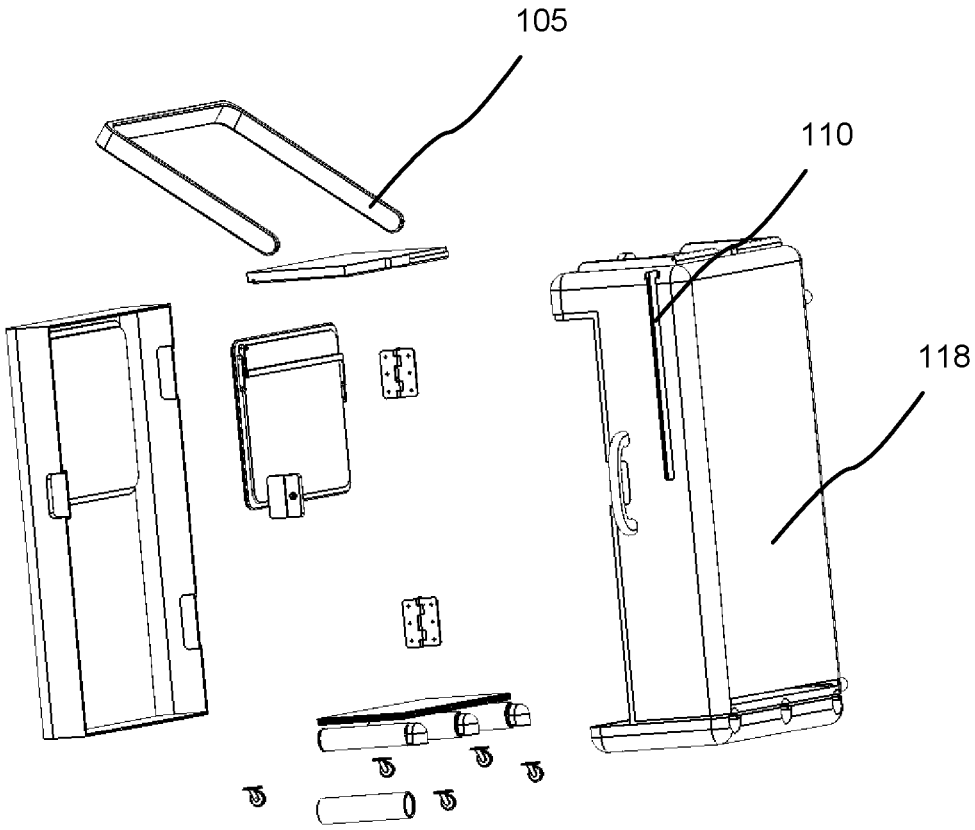
FIG. 1D is a disassembled side perspective view of a multifunctional luggage implement station in accordance with the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

FIG. 1A-1D illustrate perspective views of a multifunctional luggage implement 100 in accordance with the present invention.

The apparatus 100 comprises a plurality of wheels 114*a-c* which may position on a retractable base 104 and which rotate axially around axes which depend from the luggage 100. The retractable base 104 telescopes forward to form a cart.

In various embodiments, the device 100 comprises a forward housing 116 and rearward housing 118 which are hingedly connected. A handle 112 may dispose along a lateral surface of either the forward housing 116 and/or the rearward housing 118.

A semi-rectangular or arcuate handle 105 is slidably affixed to the either the forward housing 116 or the rearward housing 118 within a track 110 such that the handle 105 may slide upward or downward on a longitudinal axis, sliding upward when needed for dragging the device 100 on its wheels 114 and downward for stowing the luggage. The handle 105 may be shaped to contour on the top surface of the device 100.

A plurality of wheels 114*a-c* position on the bottom surface of both the forward housing 116 and rearward housing 118. These wheels 114 may comprise casters. In various embodiments, as further described below, the wheels 114 are alternatively affixed to a retractable platform.

Figure 2A:
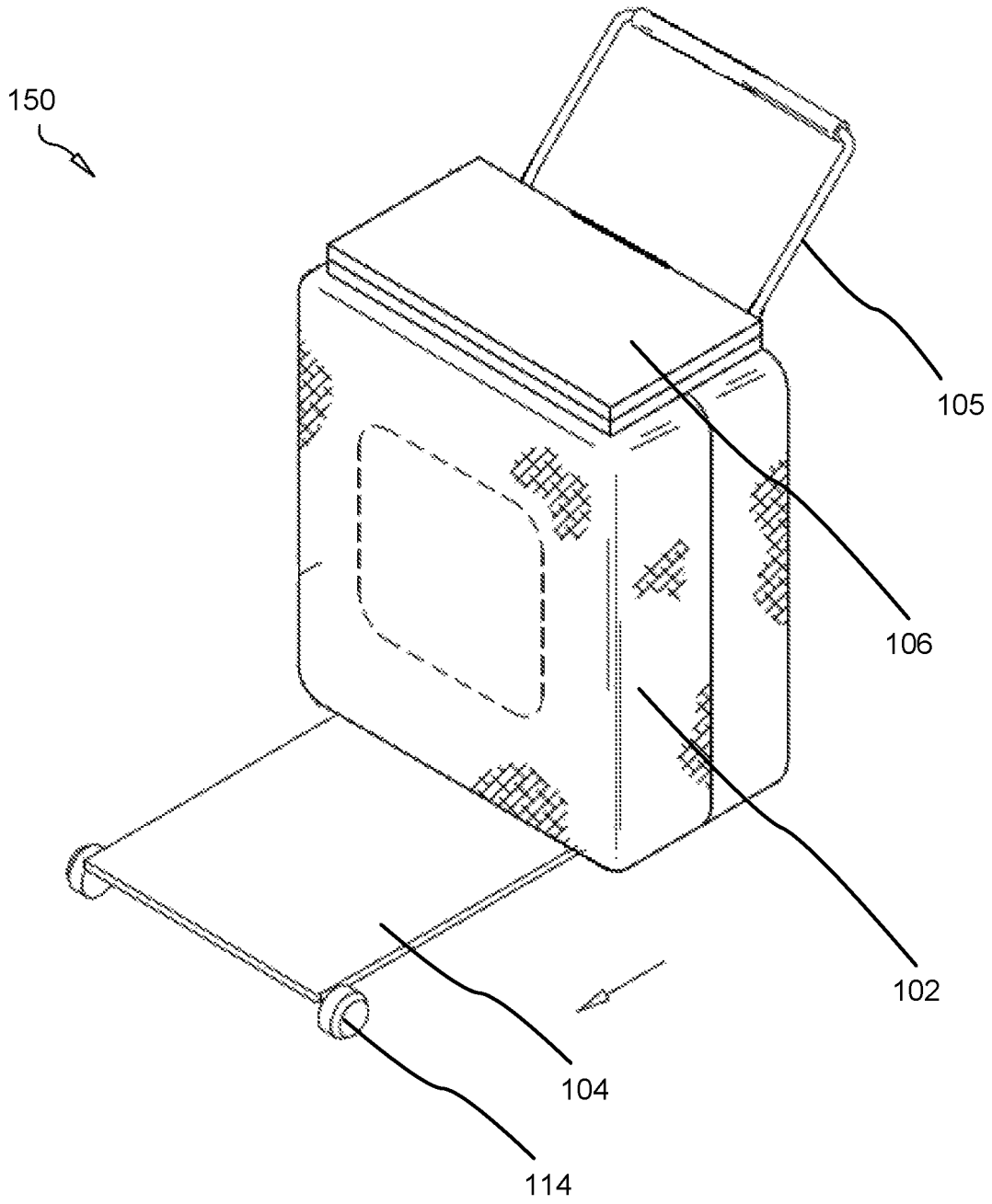
FIG. 2A is a top side perspective view of a multifunctional luggage implement with integrated changing station in accordance with the present invention.

FIG. 2A is a top side perspective view of a multifunctional luggage implement 150 in accordance with the present invention.

A fold down seat portion traverses the back support panel of the luggage implement 100 to form the child set proximate to the upper top planar surface of the luggage. Generally, the child seat is arranged so that the child's legs extend over the wider front side of the luggage 100. The apparatus 150 comprises a plurality of wheels 114 on a retractable base 104 which rotate axially around axes which depend from the luggage 150. The retractable base 104 telescopes forward to form a cart.

In various embodiments, the cart formed by extending the retractable base 104 forward can be used to port additional luggage through an airport, parking lot, or the like.

Some children older than approximately three years old may find these seat disposed above the luggage/device 150 confining and often attempt to climb out. Consequently, a second foldable seat 106 is disposed alongside the luggage 302.

Figure 2B:
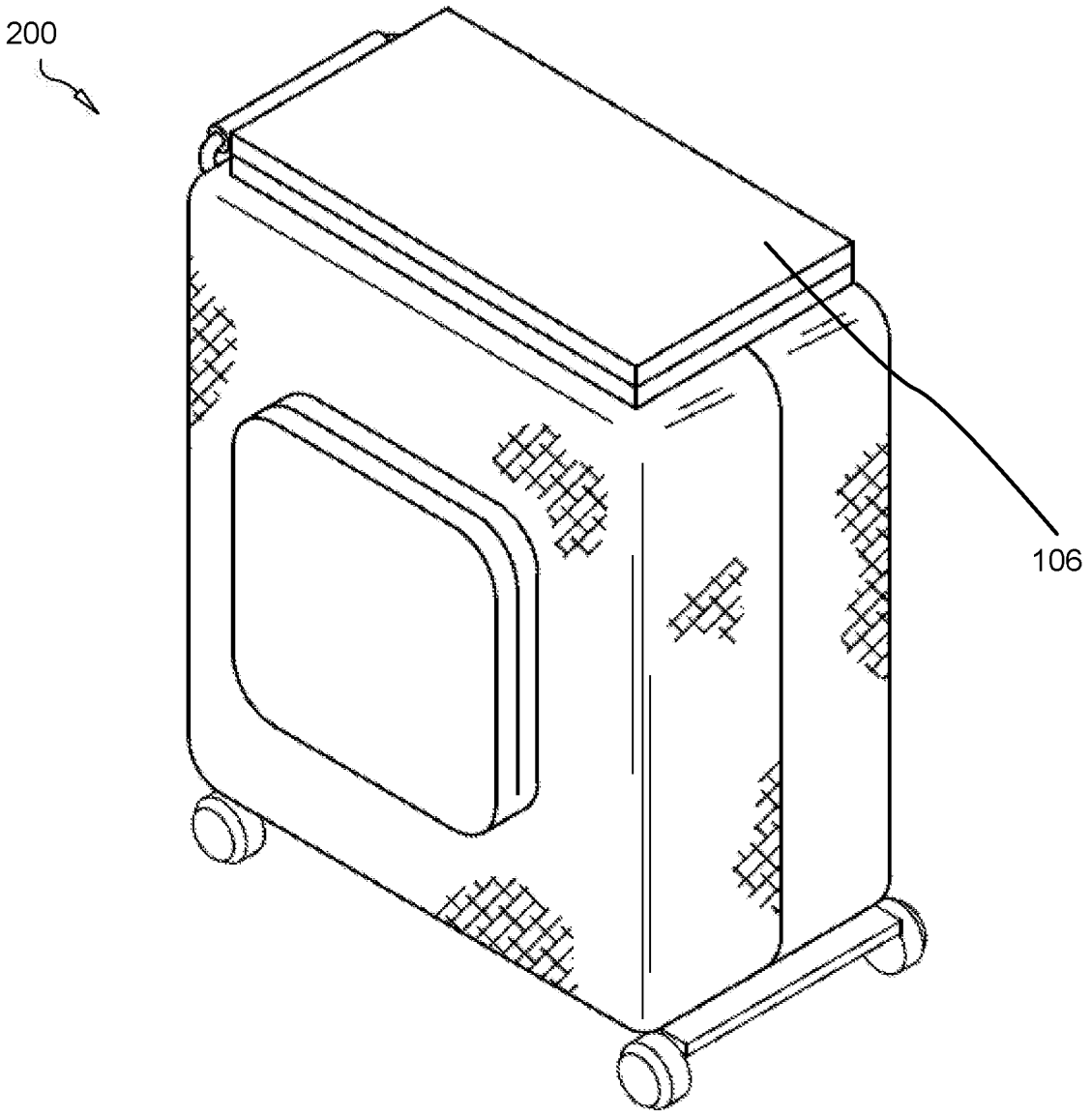
FIG. 2B is a top side perspective view of a multifunctional luggage implement with integrated changing station in accordance with the present invention.

FIG. 2B is a top side perspective view of a multifunctional luggage implement 200 with integrated changing station and stroller in accordance with the present invention.

In various embodiments, the luggage implement 200 may comprise a global positioning system (GPS) tracker for determining where the luggage implement 200 is located if lost or misplaced.

Figure 3:
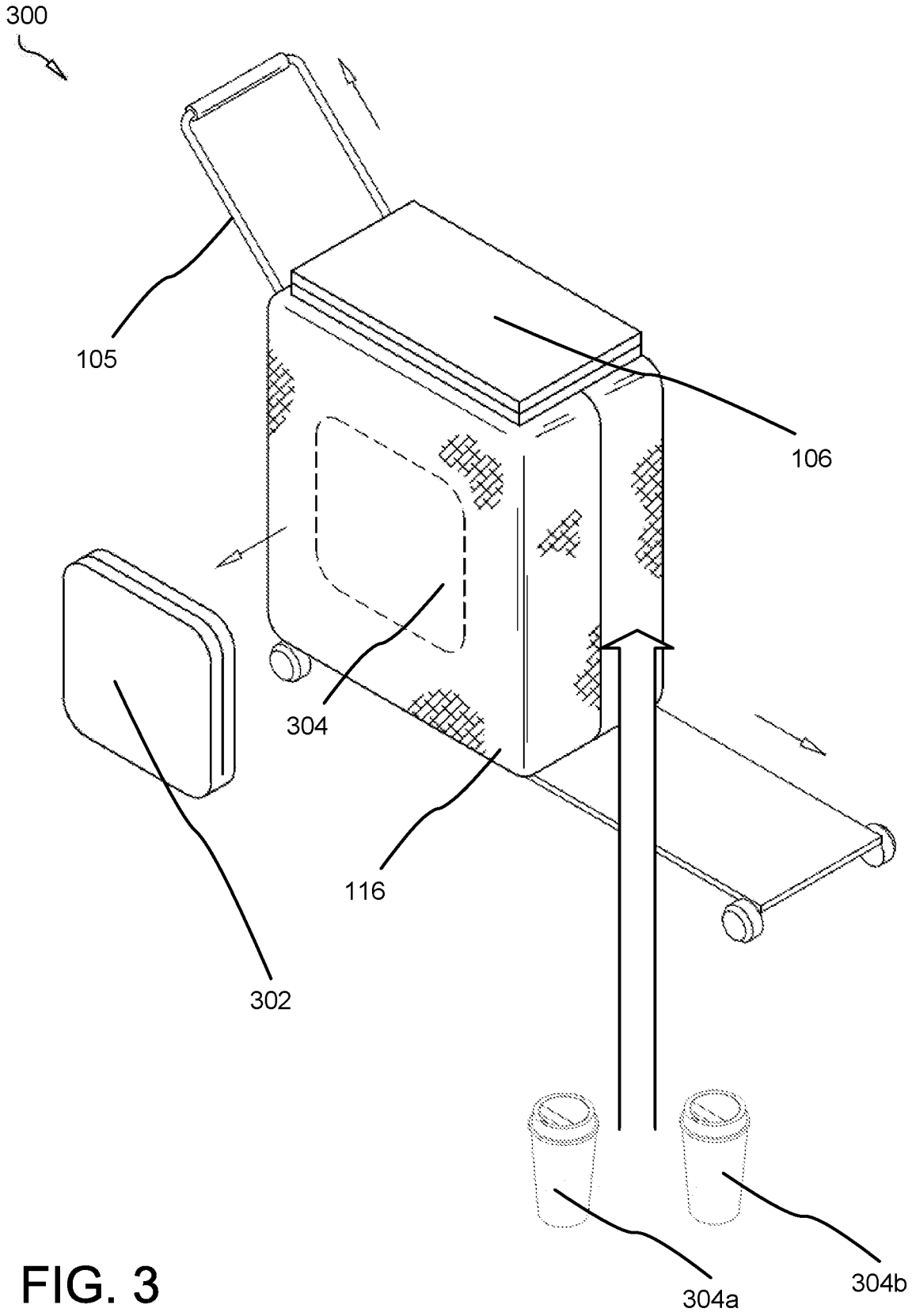
FIG. 3 is a top side perspective view of a multifunctional luggage implement with integrated changing station and a detached multiconfigurable panel in accordance with the present invention.

FIG. 3 is a top side perspective view of a multifunctional luggage implement with integrated changing station and stroller in accordance with the present invention.

The detachable panel 302 comprises two hingedly connected subpanels which join at their base. The subpanels fold outward away from each other 90 degrees to form a seat for carrying a child and alternatively fold away from each other 180 to form a plank which can double as a hammock or bed for resting a child as further shown below in relation to FIG. 8. The detachable panel 302 is further described below.

In various embodiments, the luggage implement 300 comprises one or more insulated beverage containers for receiving and contained one or more beverages 304*a-b* as shown. The insulated beverage containers may be disposed interiorly to the luggage implement 300 or otherwise disposed around the exterior of the luggage implement 300. The insulated beverage containers may be detachably affixable to the handles depending from the luggage implement 300. In some embodiments, the beverages are accessible via a side wall horizontally opposed to the detachable panel 302 on the luggage implement 300.

The forward housing 116 defines a hollow rectangular recess for receiving the panels 302.

Figure 4:
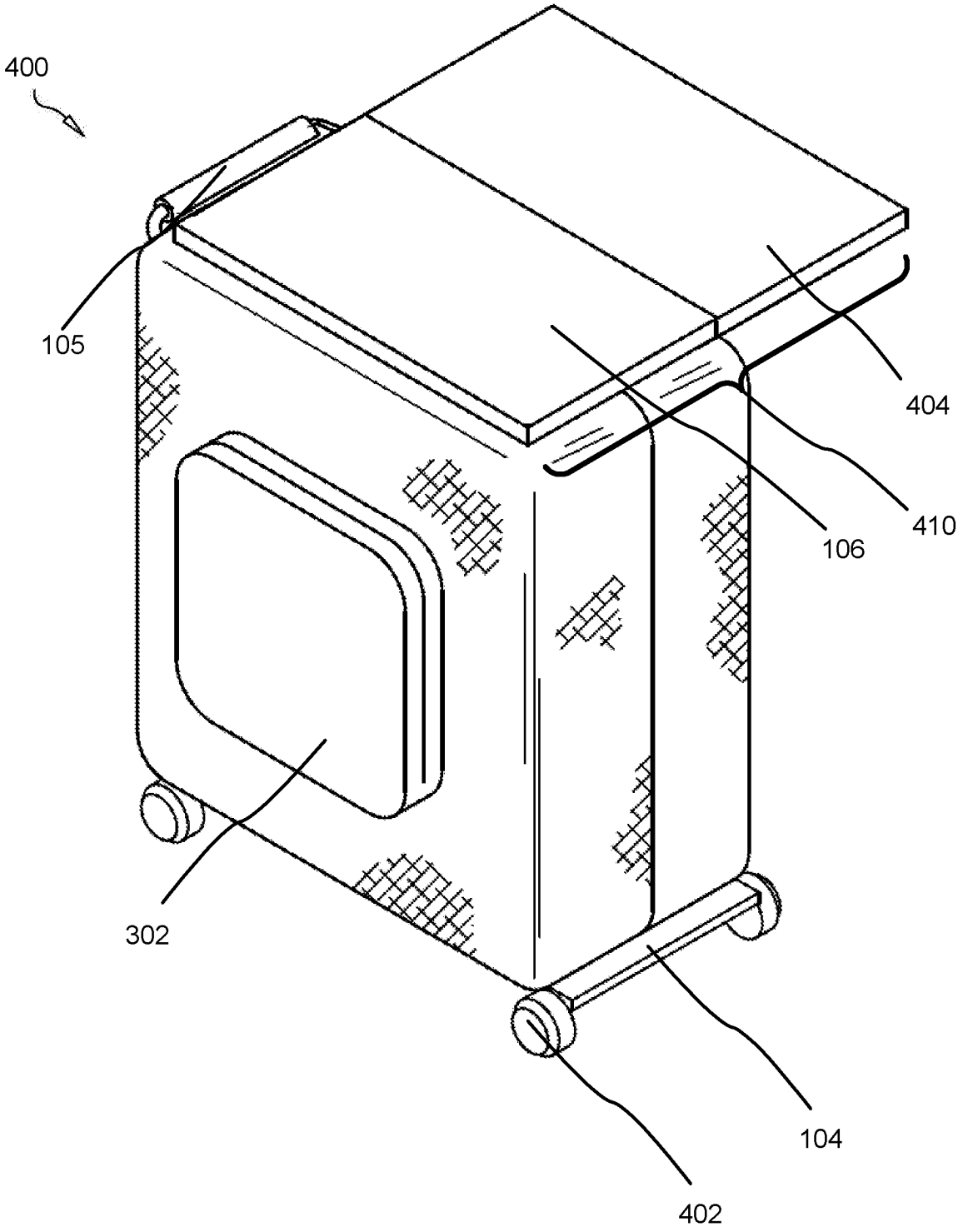
FIG. 4 is a top side perspective view of a multifunctional luggage implement with integrated changing station and desk in accordance with the present invention.

FIG. 4 is a top side perspective view of a multifunctional luggage implement 400 with integrated changing station and desk in accordance with the present invention. In various embodiments, the apparatus 400 comprises a desk (or changing station) assembly 410 having subpanels 106, 114 which are hingedly connected to one another and/or a housing 116, 118 and which fold away to become a desk or changing station as shown.

Figure 5:
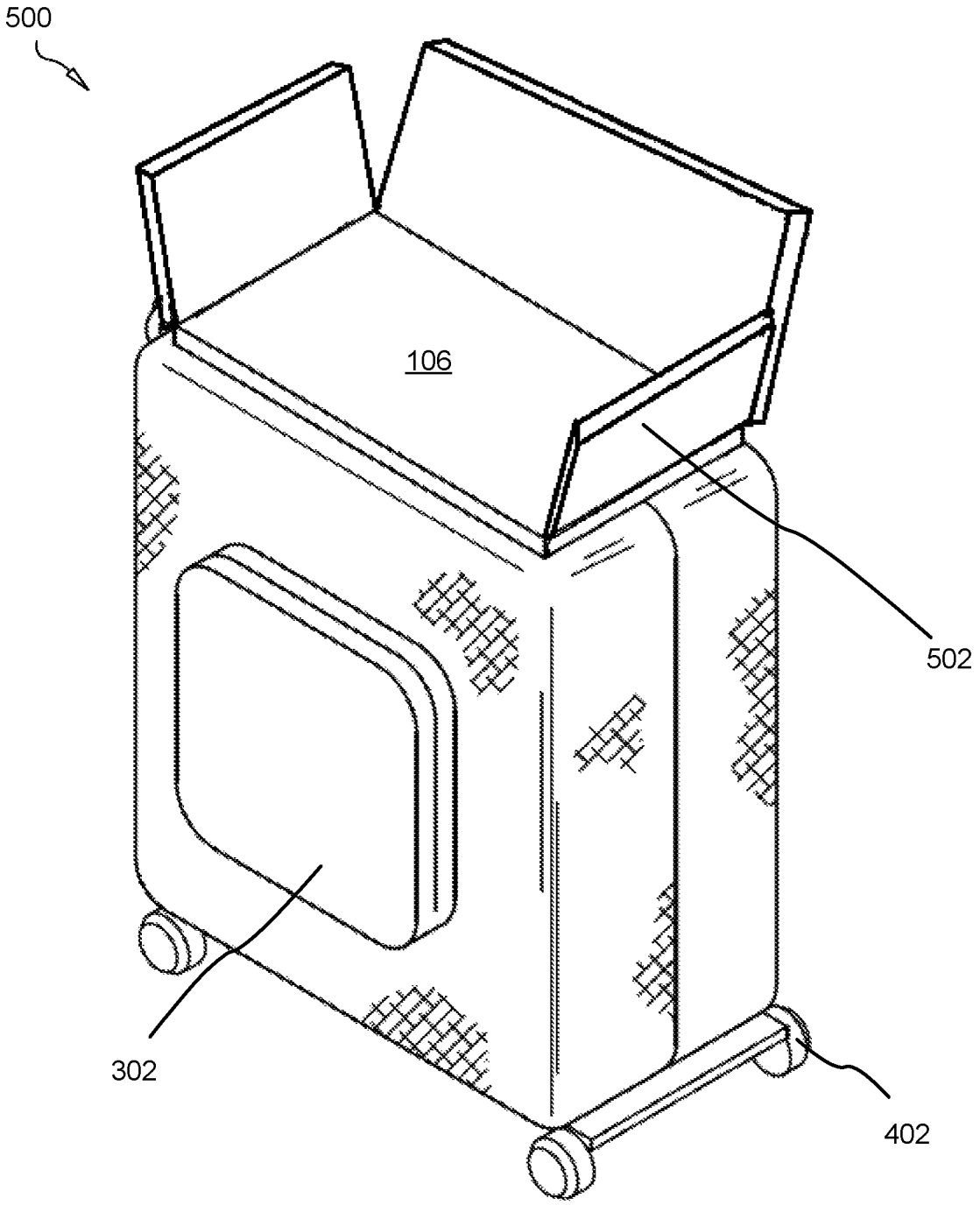
FIG. 5 is a top side perspective view of a multifunctional luggage implement with integrated changing station in accordance with the present invention.

FIG. 5 is a top side perspective view of a multifunctional luggage implement with integrated changing station and stroller 500 in accordance with the present invention. A telescoping pair of casters are affixed to the lower surface of the luggage 500.

The desk/changing station assembly 410 may comprise one or more lateral panels 502 which are hingedly connected to panel 106 as shown.

As shown, the top panels 106 fold open to form a seat within which a child can sit and/or be strapped.

The panels 302 detach from the body of the apparatus 500. The panels 302 comprise a zipper which circumscribes three of the four sides of the panels 302. The panels 302 are adapted to form a carrying bag for a laptop, diapers, personal items, and the like. In various embodiments, the panels 302 fold open to form hammock or bed for resting a child on a plane between seats.

Figure 6:
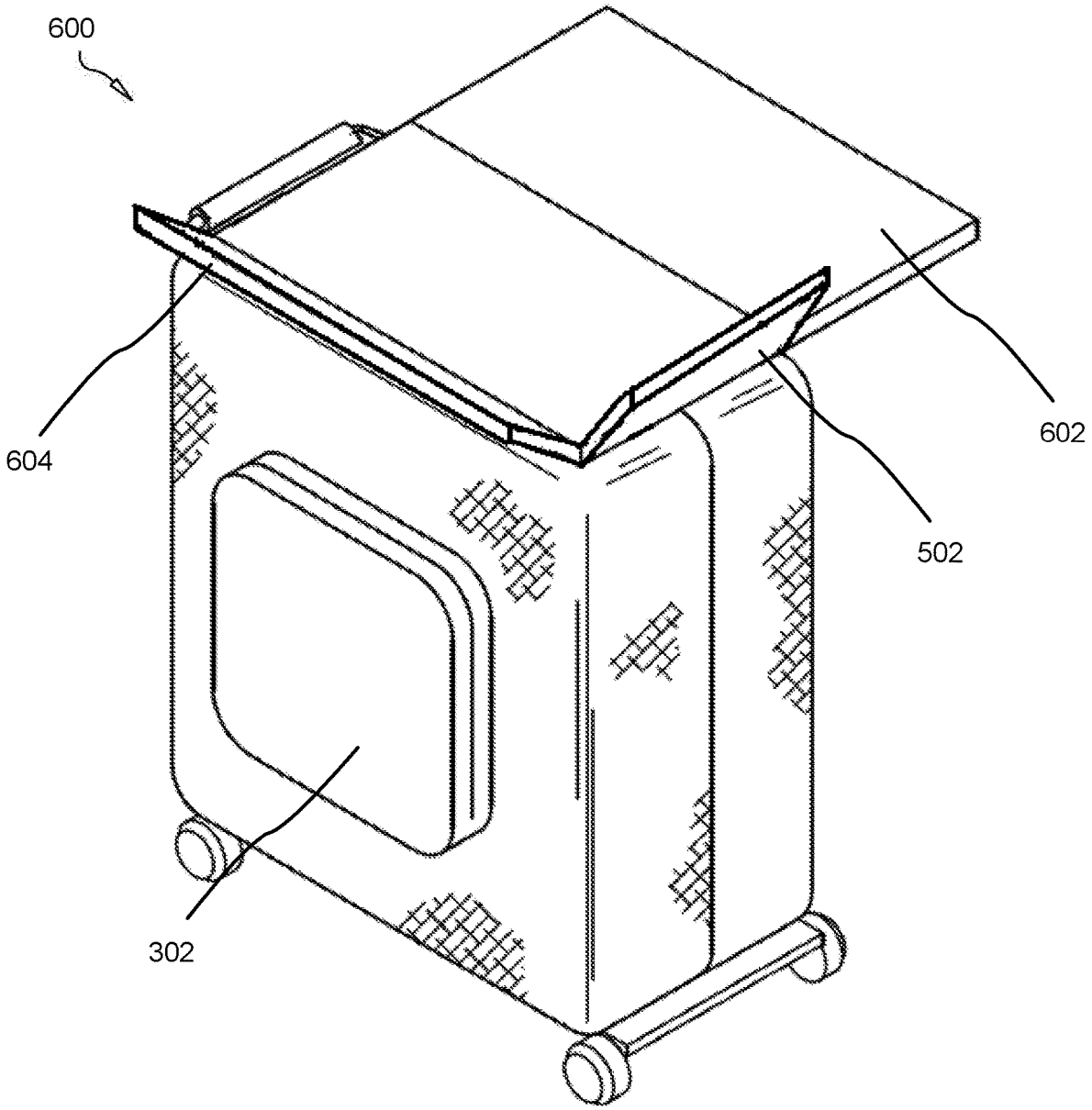
FIG. 6 is a top side perspective view of a multifunctional luggage implement with integrated changing station in accordance with the present invention.

FIG. 6 is a top side perspective view of a multifunctional luggage implement with integrated changing station and stroller 600 in accordance with the present invention.

This folding panel 106 may unfold outwards to form a platform for resting personal products like a laptop, or may alternatively fold open to form a child changing station.

Figure 7:
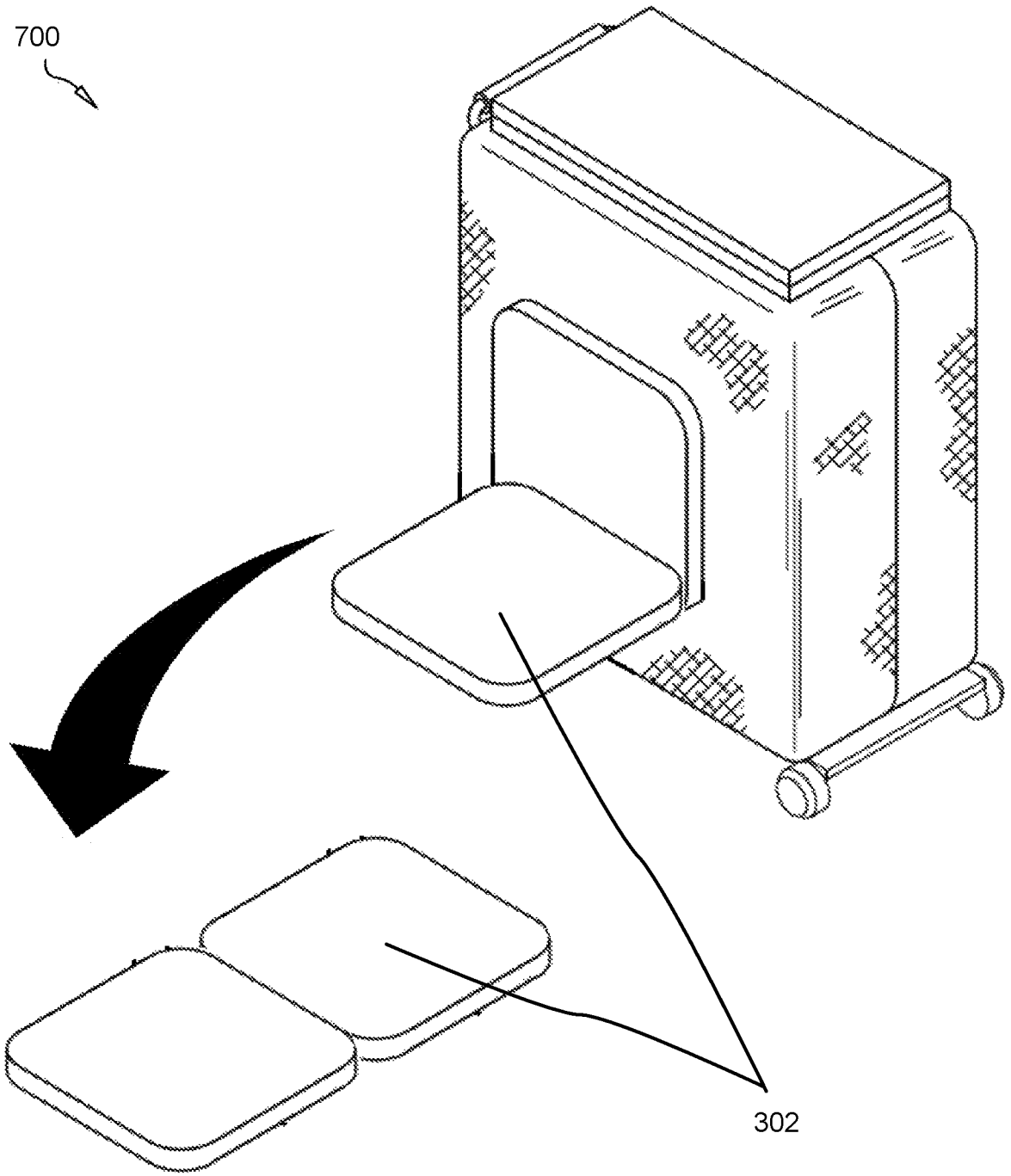
FIG. 7 is a top side perspective view of a multifunctional luggage implement with integrated changing station with a detached multiconfigurable panel in accordance with the present invention.

FIG. 7 is a top side perspective view of a luggage implement for construction of a child bed in accordance with the present invention.

Figure 8:
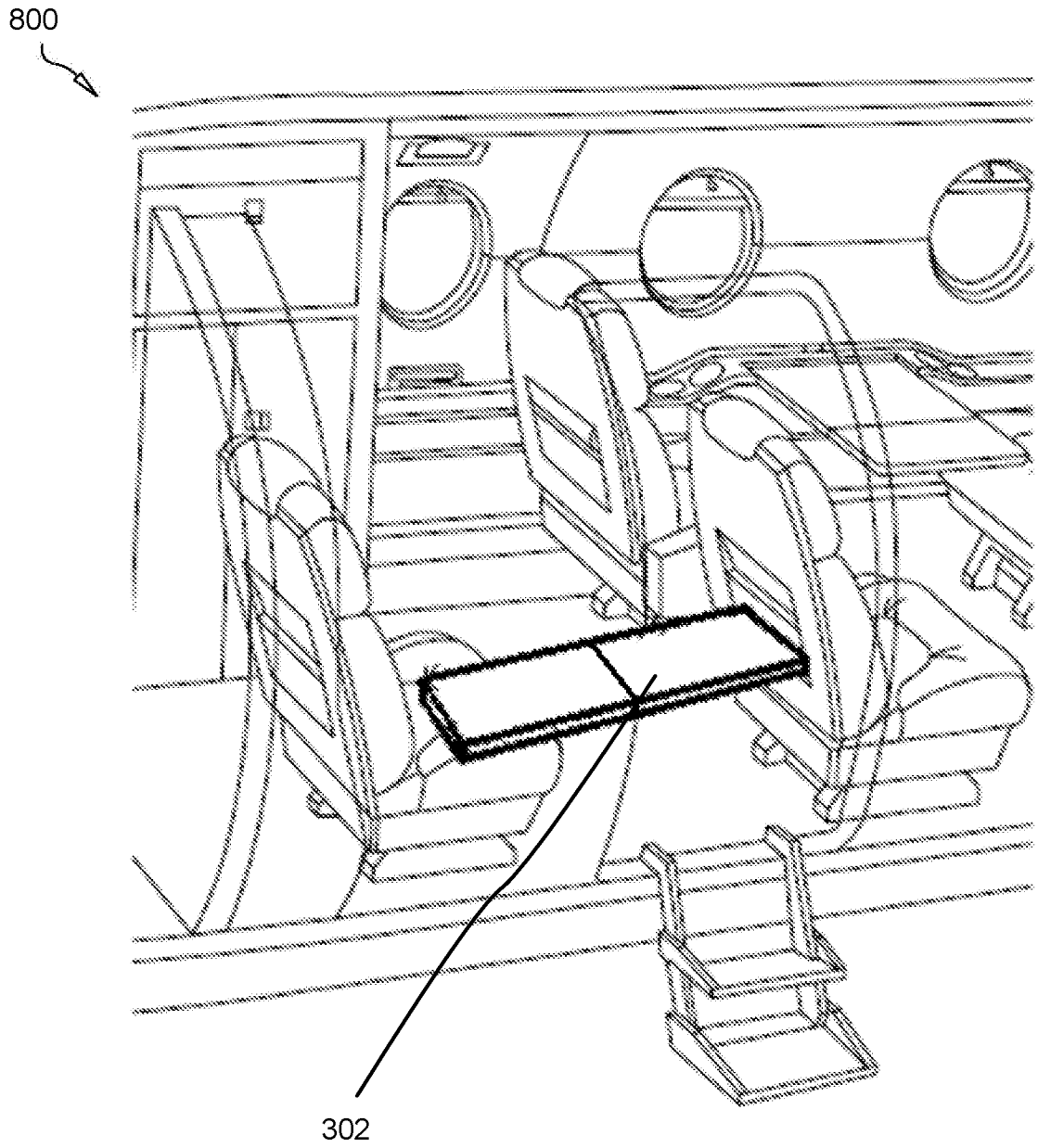
FIG. 8 is a top side perspective view of a detached multiconfigurable panel in accordance with the present invention.

FIG. 8 is a top side perspective view of a multifunctional luggage implement with integrated changing station and stroller in accordance with the present invention.

Figure 9:
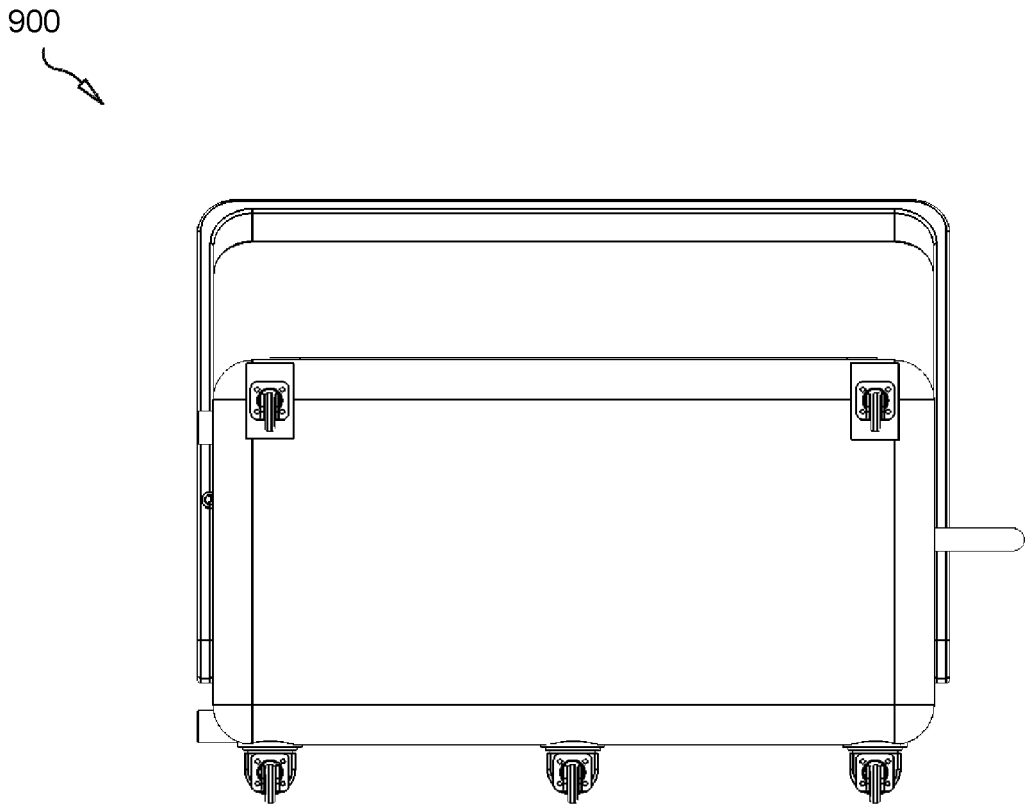
FIG. 9 is a lower perspective view of a multifunctional luggage implement in accordance with the present invention.
Figure 10:
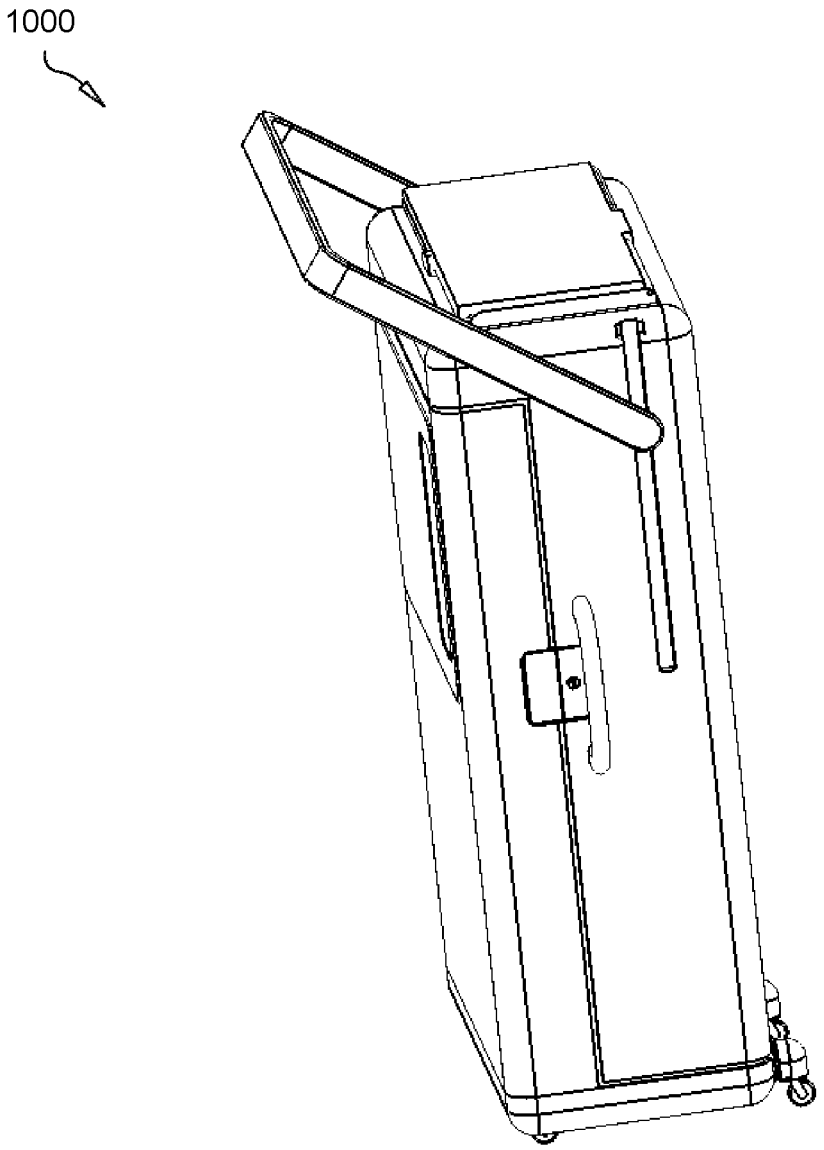
FIG. 10 is a top side perspective view of a multifunctional luggage implement in accordance with the present invention.

FIGS. 9-10 as shown.

Figure 11:
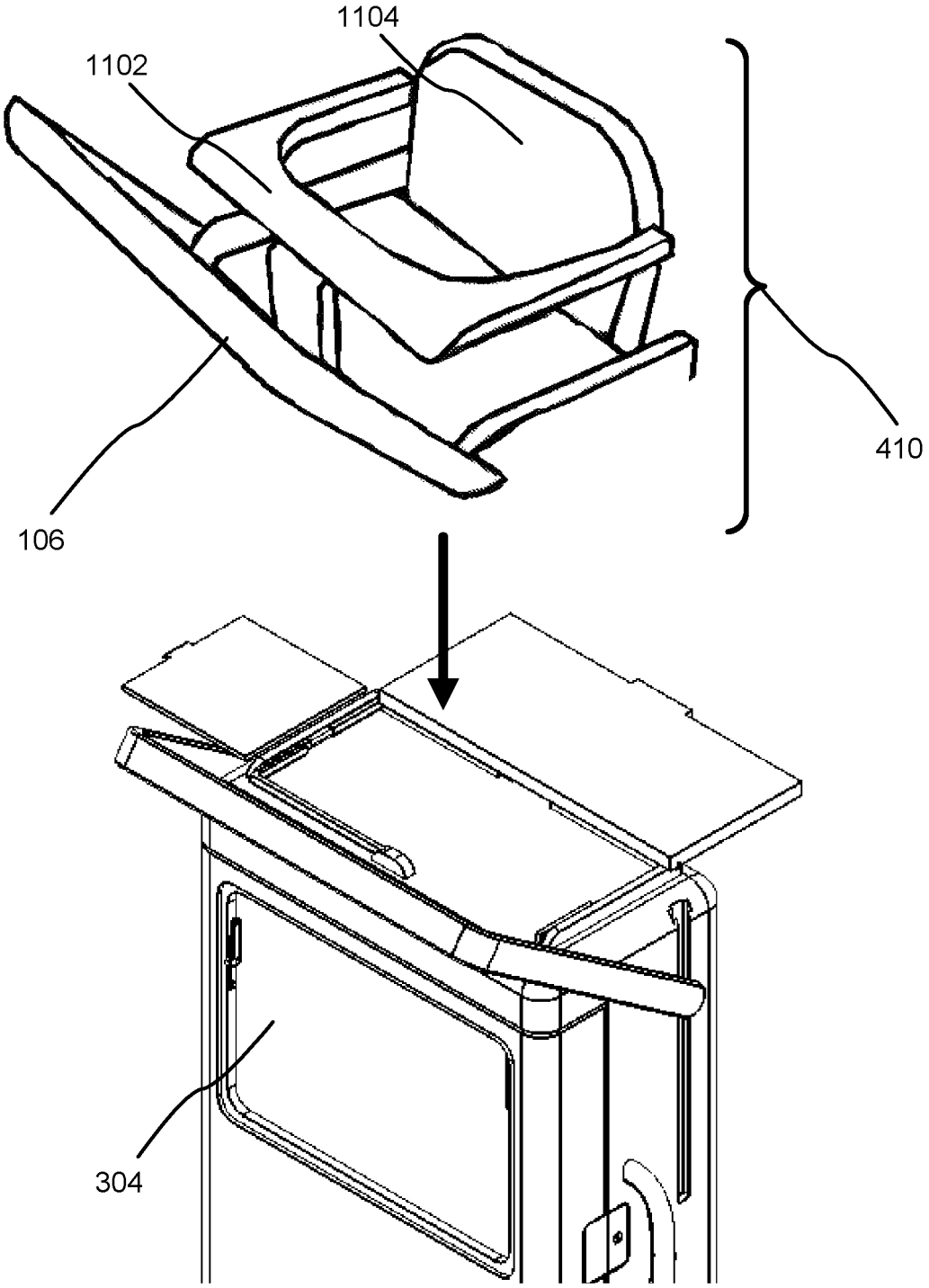
FIG. 11 is a disassembled top side perspective view of a multifunctional luggage implement in accordance with the present invention.

FIG. 11 is a disassembled top side perspective view of a multifunctional luggage implement in accordance with the present invention.

As shown, the desk assembly 410 may comprise more than just planar panels 106, 404, 502, but may comprise an upwardly rising arcuate child securement component 1102 which a child straddles when seated and a chair 1104. The chair 1104 may comprise a panel 502 which joins detachably with the child securement component 1102.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A multifunctional luggage implement comprising:
- a cubic luggage container;
- a plurality of retractable wheels;
- an assembly comprising two planar top panels hingedly affixed to a top surface of the luggage container which unfold to form a plank;
- a foldable detachable panel insertable into a recess defined by a side of the luggage container, the foldable detachable panel comprising two hingedly-connected subpanels which fold away from each other at 90 degrees; and
- one or more handles for pushing the luggage implement, the handles slidably affixed to the cubic luggage container such that the handles travel longitudinally within a track defined by an exterior surface of the cubic luggage container.

2. The multifunctional luggage implement of claim 1, wherein the planar panels fold open to form a desk.

3. The multifunctional luggage implement of claim 1, wherein the retractable wheels extend to form a cart for porting incidental luggage.

4. A multifunctional luggage implement comprising:
- a cubic luggage container comprising:
  - a forward housing defining a rectangular recess for receiving a foldable detachable panel, and
  - a rearward housing hingedly connected to the forward housing;
- a plurality of casters affixed to a bottom surface of the forward housing;
- a plurality of casters affixed to a bottom surface of the rearward housing;
- a panel assembly comprising a plurality of planar panels, the panel assembly affixed to a top surface of the luggage, the planar panels adapted to unfold to form a changing station and seat for a child;
- a foldable detachable panel insertable into the side of the luggage container which folds to form a seat for a child, wherein the foldable detachable panel forms a plank for resting the child upon in an airplane; and
- one or more handles for pushing the luggage implement.

5. The multifunctional luggage implement of claim 4, further comprising a plurality of detachable beverage containers for insulated and containing one or more beverages.

6. The multifunctional luggage implement of claim 4, wherein the planar panels fold open to form a desk.

7. The multifunctional luggage implement of claim 4, wherein the planar panels fold open to form a child changing station.

8. The multifunctional luggage implement of claim 4, wherein the planar panels detach to form a bed for resting a child between seats of an airplane.

9. The multifunctional luggage implement of claim 4, further comprising a handle affixed to the rearward housing.

10. The multifunctional luggage implement of claim 4, further comprising a semi-rectangular handle slidably affixed to the rearward housing, the semi-rectangular handle adapted to slide within a track defined by the rearward housing.

* * * * *